United States Patent [19]

Narusawa et al.

[11] Patent Number: 4,513,075

[45] Date of Patent: Apr. 23, 1985

[54] DEVELOPER MATERIALS FOR ELECTROSTATIC IMAGES

[75] Inventors: Toshiaki Narusawa, Sagamihara; Seiji Okada, Kawasaki; Kiyohide Muramatsu, Tokyo; Teruo Yagishita, Kawasaki; Hirofumi Okuyama, Sagamihara, all of Japan

[73] Assignee: Fujitsu Limited, Kawasaki, Japan

[21] Appl. No.: 320,609

[22] Filed: Nov. 12, 1981

Related U.S. Application Data

[63] Continuation of Ser. No. 62,311, Jul. 30, 1979.

[30] Foreign Application Priority Data

Aug. 1, 1978 [JP] Japan ..... 53-93110
Mar. 26, 1979 [JP] Japan ..... 54-34221

[51] Int. Cl.[3] ..... G03G 9/10

[52] U.S. Cl. ..... 430/108; 430/109; 430/904

[58] Field of Search ..... 430/106.6, 107, 108, 430/109, 904

[56] References Cited

U.S. PATENT DOCUMENTS

| | | | |
|---|---|---|---|
| 3,526,533 | 9/1970 | Jacknow et al. | 428/403 |
| 3,718,594 | 2/1973 | Miller | 430/114 |
| 3,939,086 | 2/1976 | Hagenbach | 430/108 |
| 4,020,358 | 5/1977 | Tomono et al. | 430/109 |
| 4,137,188 | 1/1979 | Uetake et al. | 430/111 |

*Primary Examiner*—John D. Welsh
*Attorney, Agent, or Firm*—Staas & Halsey

[57] ABSTRACT

A developer material for electrostatic images comprising a mixture of (1) a coated carrier and (2) a toner.

(1) The carrier consists of core beads coated with a coating resin comprising a butadiene homopolymer of a molecular weight of from 10,000 to 100,000, for the butadiene homopolymer is 1,2-polybutadiene and/or cyclized cis-1,4-polybutadiene or a mixture of at least one of these homopolymers and a styrene/butadiene copolymer of a molecular weight of from 10,000 to 100,000, the mixture containing from 7.5 to 100% by weight, based on the weight of the mixture, of butadiene in polymerized form.

(2) The toner comprises, based on the weight of the toner, (A) from 85 to 95% by weight of a binder resin comprising, based on the weight of the binder resin, from 50 to 100% by weight of an epoxy resin of a molecular weight of from 900 to 8,000 and from 0 to 50% by weight of a styrene/alkyl methacrylate copolymer, the alkyl group having from 1 to 4 carbon atoms, of a molecular weight of from 10,000 to 100,000; (B) a colorant comprising, based on the weight of the toner, from 0 to 10% by weight of fine carbon and from 0.5 to 8% by weight of a nigrosine dye, and; (C) from 0 to 8% by weight of a charge controlling agent, based on the weight of the toner, comprising a quaternary ammonium alkyl sulfonate, the alkyl group having from 4 to 20 carbon atoms, or di-(polyhydroxyethoxy ethyl) octadecyl amine, or a polyamine.

The ratio of the total surface area of the coated carrier to the total projection area of the toner particles is in the range of from 1:0.5 to 1:2.0.

14 Claims, 5 Drawing Figures

DEVELOPER MATERIALS FOR ELECTROSTATIC IMAGES

This is a continuation of application Ser. No. 62,311 filed 30 July 1979.

BACKGROUND OF THE INVENTION

The present invention relates to developer materials for electrostatic images, particularly for use in an electrostatic high speed printer and the like.

The developer material for use in electrostatic development comprises a mixture of smaller resinous toner particles and larger carrier beads made of iron or glass. The toner particles are held on the surface of the carrier beads by electrostatic force, which develops from the contact therebetween producing triboelectric charging of the toner particles and the carrier in opposite polarities. When the developer material is moved into contact with the latent electrostatic images formed on a photoreceptor, the toner particles are attracted to the latent images, and, thus, the images are developed. The developed images are transferred onto plain paper and fixed thereon by heating.

Generally, such a dry developer material has problems which are difficult to solve, such as toner filming of the carrier beads and throwing-off of the toner particles during agitation of the developer material in a developing station.

Here, the term "throwing-off" means that the toner particles are thrown out from the developing station and scattered during the rotation of the magnetic roll of the developing station by moving air, centrifugal force or mechanical impulse.

The toner filming occurs due to the recycling of the carrier through many cycles producing many collisions. The attendant mechanical friction causes the toner material to partly melt and stick on the surface of the carrier beads, thus, forming a film of toner thereon. The toner filming impairs the normal triboelectric charging of the toner particles in the developer mixture, because the normal toner-carrier triboelectric charging is partly replaced by a toner-toner relationship. The improperly charger toner particles can be deposited on the non-image areas, whereby the quality of the printed matter is impaired, because the non-image areas possess an unacceptable level of background.

When the toner filming grows to a certain degree, the entire developer material must be replaced, thereby, increasing the cost of operation of a development apparatus. Furthermore, the replacement is time consuming. This is especially significant in a high speed printer.

The throwing-off problem occurs due to weak electrostatic charging between the toner particles and the carrier beads. When the developer material is vigorously agitated in the developing station, the toner particles are attracted to and adhered on the carrier beads. However, some of the toner particles are apt to separate from the carrier and fly up to deposit on a non-image area of the photoreceptor, and also, on the inner surface of the printer. As a result, fogging of the images occurs and the performance of the optical system including the corotron is impaired. Consequently, the electrostatic charging must be large enough to avoid the throwing-off of the toner particles.

It is well known that the carrier beads can be coated with a resin so as to reduce the formation of toner filming. However, the resin must be easily and uniformly coated on the surface of core beads and firmly fixed thereon.

The coated carrier beads and the toner particles are required to exhibit at least the following features during operation.

(A) The carrier beads must effect the necessary triboelectric charging of toner particles and a sufficient number of toner particles must be held on the coated surface of the carrier beads to exhibit a high optical density of the images, and also, to reduce the throwing-off of the toner particles so as not to cause fogging of the images.

(B) The coating resin must not peel off from the core beads and must be resistant to abrasion. Even if the coating chips, flakes or spalls, the fine powder must not cause fogging of the images and corrosion of the developing station, and toxic materials must not be separated.

(C) The resinous material of the toner particles must not stick to the coating resin during agitation, that is, must reduce the formation of undesirable toner filming which impairs the normal triboelectric charging, and must not run on the paper during fusation, that is, must improve the resolution.

In the prior art, the developer material for use in an electrostatic high speed printer does not satisfy all of the features (A) through (C) above, although several patents disclose methods of improving the behavior of either the toner or the carrier.

For example, carrier beads are coated with a fluorine containing polymer and a modifying material which are physically mixed with each other. It is necessary in order to obtain a uniform coating that a diluted formulation of the polymer which includes chromium oxide be sprayed onto the core beads suspended in a cyclic fluidized bed tower. The process is complicated.

SUMMARY OF THE INVENTION

An object of the present invention is to provide an electrostatic developer material which is capable of producing printed images with a high optical density.

Another object of the present invention is to provide an electrostatic developer material which is capable of producing printed images with a high resolution.

Still another object of the present invention is to provide an electrostatic developer material, the toner particles of which is fixed by irradiation with visible light having an ultra violet component.

Yet another object of the present invention is to provide an electrostatic developer material which can prevent the throwing-off of the toner particles from the surface of the carrier so that the background of the printed images is clear.

A further object of the present invention is to provide an electrostatic developer material which can prevent formation of toner filming on the surface of the carrier so that the carrier has a long operational life.

A still further object of the present invention is to provide an electrostatic developer material, the toner of which, particularly the colorant of the toner, is stable during storage and does not produce toxic or harmful materials during printing.

A yet further object of the present invention is to provide an electrostatic developer material, particularly the coated carrier, which can be produced without difficulties.

A developer material for electrostatic images comprising a mixture of (1) a coated carrier and (2) a toner is proposed.

(1) The carrier consists of core beads coated with a coating resin comprising a butadiene homopolymer of a molecular weight of from 10,000 to 100,000, or a mixture of at least one of these homopolymers and a styrene/butadiene copolymer of a molecular weight of from 10,000 to 100,000, the mixture containing from 7.5 to 100% by weight, based on the weight of the mixture, of butadiene in polymerized form.

(2) The toner comprises, based on the weight of the toner, (A) from 85 to 95% by weight of a binder resin comprising, based on the weight of the binder resin, from 50 to 100% by weight of an epoxy resin of a molecular weight of from 900 to 8,000 and from 0 to 50% by weight of a styrene/alkyl methacrylate copolymer, the alkyl group having from 1 to 4 carbon atoms, of a molecular weight of from 10,000 to 100,000; (B) a colorant comprising, based on the weight of the toner, from 0 to 10% by weight of fine carbon and from 0.5 to 8% by weight of a nigrosine dye, and; (C) from 0 to 8% by weight of a charge controlling agent, based on the weight of the toner, comprising a quaternary ammonium alkyl sulfonate, the alkyl group having from 4 to 20 carbon atoms, or di-(polyhydroxy ethoxy ethyl)octadecyl amine, or a polyamine. The optional components of the present invention may be present in any effective amount within the recited ranges, for achieving the purposes of the present invention.

The ratio of the total surface area of the coated carrier to the total projection area of the toner particles is in the range of from 1:0.5 to 1:2.0.

Here, the term "projection area of the toner particles" means the shadowing area occupied by these toner particles.

The foregoing and other objects, features and advantages of the invention will be more apparent from the following description.

DETAILED DESCRIPTION OF THE PREFERRED EMBODIMENTS

Figure 1:
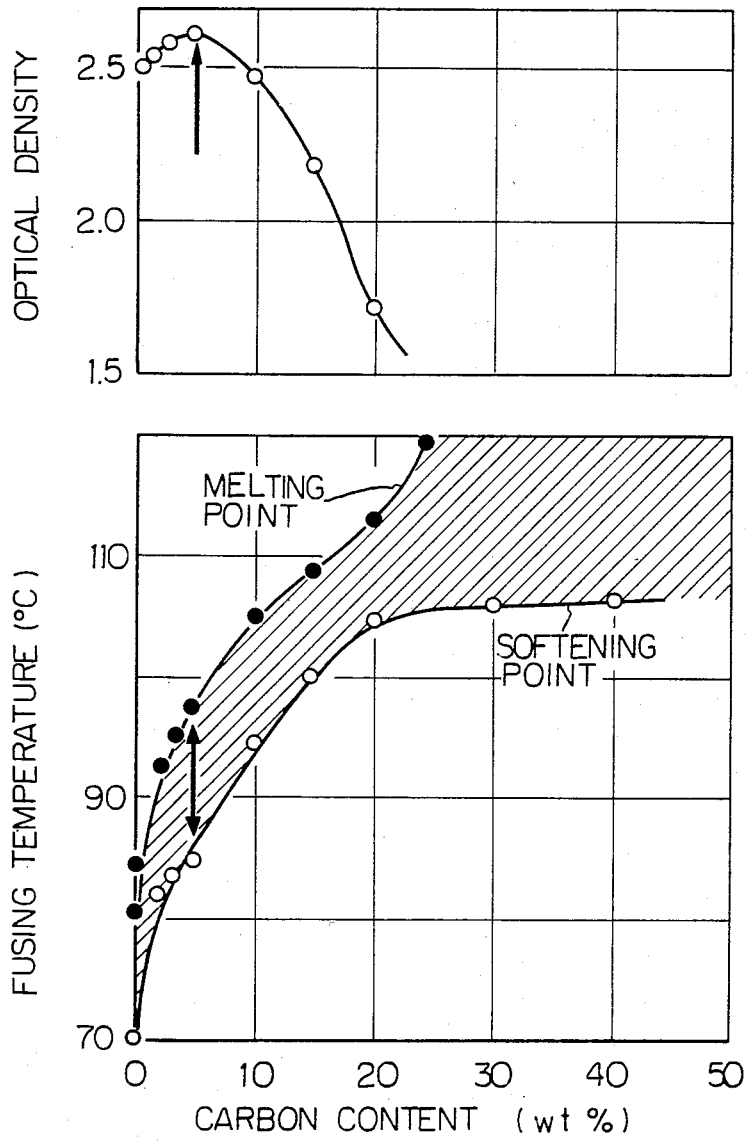
FIGS. 1A and 1B show the optical density and fusing temperature of a disc of fused epxoy resin and carbon as a function of carbon content.

A carrier coated with a resin containing butadiene in polymerized form exhibits less tendency towards toner filming than bare iron or glass beads. In addition, such a carrier can be easily produced by mixing the resin with an adequate organic solvent and drying the mixture using a rotary drying method.

The coating resin of the present invention comprises a butadiene homopolymer of a molecular weight of from 10,000 to 100,000, or a mixture of this butadiene homopolymer and a styrene/butadiene copolymer of a molecular weight of from 10,000 to 100,000, the mixture containing from 7.5 to 100% by weight, based on the weight of the mixture, of butadiene in polymerized form.

The coating resin may contain more than 90% by weight of butadiene in polymerized form, based on the weight of the coating resin. The coating resin may, further, comprise less than 10% by weight of a fluorine containing polymer, based on the weight of the coating resin, so as to further reduce the tendency of the coating resin to stick to the toner resin.

Molecular weight is expressed as a number average molecular weight in this specification.

The butadiene homopolymer of the coating resin of the present invention comprises 1,2-polybutadiene or cyclized cis-1,4-polybutadiene. Cyclized cis-1,4-polybutadiene is a partially cyclized linear polymer having fewer double bonds than 1,2-polybutadiene, because they are partly opened by cyclization. After curing, cyclized cis-1,4-polybutadiene can form a three dimensional structure having a lower cross linking density and the resultant coating thereof is softer than that formed by 1,2-polybutadiene. Therefore, it is possible to blend these two types of polybutadienes so as to obtain a desired hardness of the coating.

The shape of the carrier core beads may be a spherical shot or a thin plate-like flake or a thick flake. When the core beads are made from iron, their surface is usually oxidized to be blueish colored. The size of the core beads is determined by the size of the toner particles to be mixed therewith. The size of the toner particles is usually from about 5 to about 30 μm. The size of the carrier beads may be from about 30 to 500 μm, preferably from 100 to 250 μm. If the size of the carrier beads is less than 30 μm, they cannot flow with the toner particles smoothly. If the size of carrier beads is over 500 μm, they cannot hold enough number of the toner particles per unit weight of carrier beads.

The thickness of the coating resin, according to the invention, is from 0.3 to 20 μm, preferably from 0.7 to 2.0 μm. If the coating resin is thicker than 20 μm, the coated carrier beads are apt to stick to each other, whereas the surface of the core beads coated with a resin layer thinner than 0.3 μm will be partly uncovered.

A binder resin comprising from 50 to 100% by weight of an epoxy resin forms less toner filming, than the binder resins comprising less than 50% by weight of an epoxy resin which are usually available and used to prepare toner particles. Therefore, this toner exhibits a high optical density of the images. However, at the time of fusing, fused toner particles are apt to broaden the printed area, thereby lowering the resolution of the printed images. Therefore, it is advantageous to add from 0 to 50% by weight of a styrene/alkyl metacrylate copolymer, which has a higher viscosity in the fused state.

Carbon is a non-toxic and stable colorant. However, a transparent resin in which this black pigment is dispersed reflects the light irregularly on the surface of the toner. In order to make the toner color deep, a blueish nigrosine dye is mixed to the binder resin.

Further, the electric conductivity of carbon reduces the triboelectric charge and, thereby, the toner containing carbon has a tendency to be thrown off from the surface of the carrier during agitation in the developing station. In order to compensate for the electric conductivity of carbon, a charge controlling agent is added to the toner resin. The charge controlling agent may be a quaternary ammonium alkyl sulfonate, or di-(p-hydroxy ethoxy ethyl)octadecyl amine or a polyamine. The polyamine may be a polyolefin polyamine of a molecular weight of from 1,000 to 100,000, expressed by the formula:

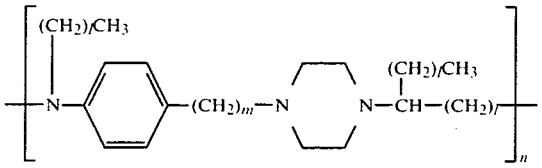

where l=0 or 1 and m=1 or 2.

The toner of the present invention comprises, based on the weight of the toner: (A) from 85 to 95% by weight of a binder resin comprising, based on the weight of the binder resin, from 50 to 100% by weight of an epoxy resin of an epoxy equivalent of from 450 to 5,500 and a molecular weight of from 900 to 8,000, and from 0 to 50% by weight of a styrene/alkyl methacrylate copolymer, the alkyl group having from 1 to 4 carbon atoms, of a molecular weight of from 10,000 to 100,000; (B) a colorant comprising, based on the weight of the toner, from 0 to 10% by weight of fine carbon and from 0.5 to 8% by weight of a nigrosine dye, and (C) from 0 to 8% by weight of a charge controlling agent, based on the weight of the toner, comprising a quaternary ammonium alkyl sulfonate, the alkyl group having from 4 to 20 carbon atoms or di-(polyhydroxy ethoxy ethyl)octadecyl amine, or a polyamine.

It is convenient to fuse the toner particles adhered on the images by visible light with an ultra violet component, without using a heating roll or a heating oven. This flash-fusible toner comprises a bis-phenol A/epichlorhydrin type epoxy resin, which cannot be decomposed at all, but can easily melt during irradiation. Therefore, it is necessary to limit the epoxy equivalent to the range of from 450 to 5,500 and the molecular weight in the range of from 900 to 8,000, and the amount of the epoxy resin in the toner resin must exceed 95% by weight. Therefore, other additives must be limited to as low a value as possible. If the content of carbon exceeds 8%, the flash light causes a higher fusing temperature. The flash-fusible toner comprises, based on the weight of the toner: (A) from 85 to 95% by weight of the binder resin comprising more than 95% by weight, based on the binder resin, of bis-phenol A/epichlorohydrin type epoxy resin, of an epoxy equivalent of from 450 to 5,500, a molecular weight of from 900 to 8,000 and a melting point of from 60° to 160° C.; (B) a colorant comprising, based on the weight of the toner, from 0.6 to 8% by weight of carbon and from 0.5 to 5% by weight of a nigrosine dye, and; (C) from 0 to 8% by weight of a charge controlling agent, based on the weight of the toner, comprising a quaternary ammonium alkyl sulfonate, the alkyl group having from 4 to 20 carbon atoms, or di-(polyhydroxy ethoxy ethyl)octadeyl amine or a polyamine.

The ratio 1:$\eta$ of the total surface of the carrier beads to the total projection area of the toner particles, is in the range of from 1:0.5 to 1:2.0, preferably from 1:0.6 to 1:1.2. If $\eta$ exceeds 2, the toner particles are crowded to such an extent on the surfaces of the carrier beads that they tend to be thrown off. If $\eta$ is lower than 0.5, the development current cannot be detected.

The toner and the coated carrier of the present invention are mixed with each other, so that the developer material exhibits the optimum results in printing. However, it is possible for the toner of the present invention to be mixed with another carrier or for the coated carrier of the present invention to be mixed with another toner.

Outline of Experiments Conducted (1) The composition of the binder resin of the toner of the present invention was determined to have a sharp glass transition temperature and a reasonably high fusing temperature, as well as a high viscosity. Consequently, the toner was not sticky at or near ambient temperature. Thus, blocking of the toner particles during storage, toner filming on the surface of the carrier beads during agitation, and diffusing out of the images during fusing were prevented.

(2) Colorant materials were chosen and the content thereof was determined by mixing colorants in the binder resin and fusing the obtained toner as a disc on plain paper.

(3) A charge controlling agent was added to produce toner particles which could generate enough triboelectric charging by compensating for the electric conductivity of the pigment during agitation with the carrier.

(4) The composition of the toner was further restricted so that the toner could be fused by irradiation with visible light having an ultraviolet component.

(5) The composition of the coating resin the carrier beads was determined by peeling a layer of fused toner from the coating resin coated on an iron plate.

(6) Finally, the mixing ratio, more exactly, the ratio of the total surface area of carrier beads to the total projection area of toner particles on the carrier was determined.

The present invention will be clearly understood by the following detailed description of experiments.

Colorants of Toner

Example 1

The optical performance of the toner components, such as colorant, are not seriously influenced by the type of a binder resin. Therefore, an epoxy resin ($E_P$ 1004, Yuka Shell Epoxy Kabushiki Kaisha) and Long Flow Carbon (Black Pearls L, migrometer index 83) were fused to shape a disc on a plain paper. As shown in FIGS. 1A and 1B, the optical density of the disc and the fusing temperature were plotted as the content of the carbon was changed. The toner containing 5% by weight of carbon, based on the weight of toner, exhibited a high optical density and a low fusing temperature.

Example 2

Figure 2:
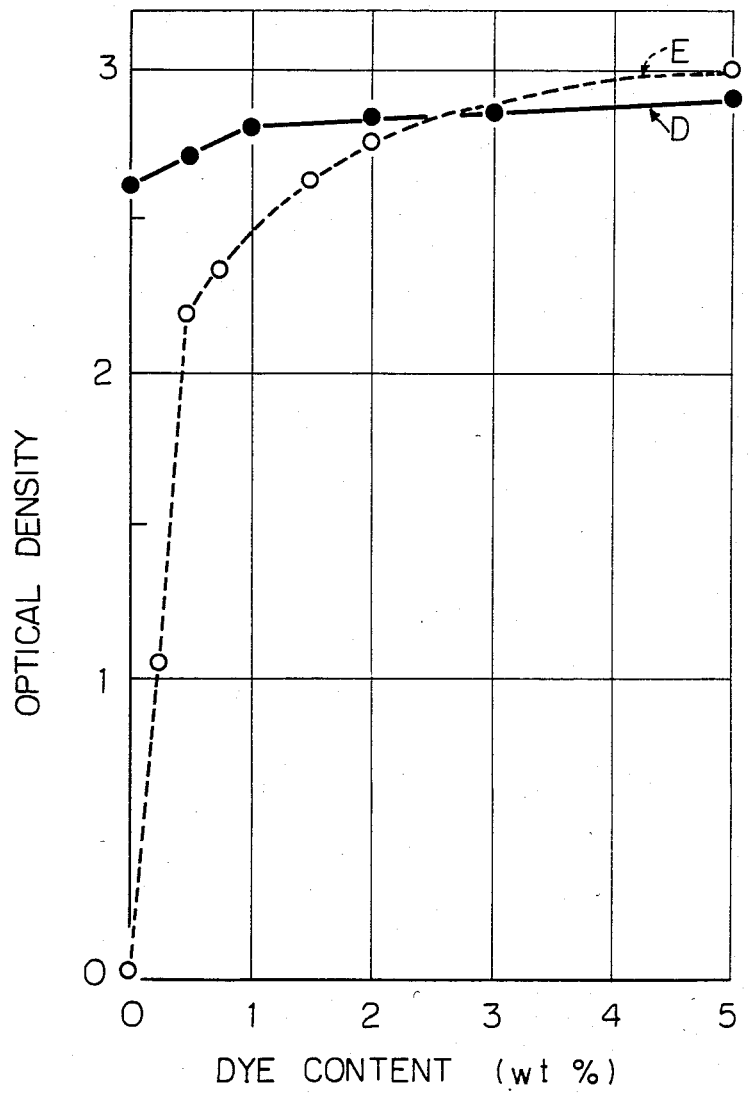
FIG. 2 shows the optical density of other fused discs with different toners as a function of dye content.

The toner used in Example 1 was modified by adding a nigrosine dye (Oil Black BY, Orient Kagaku Co.), which does not contain a heavy metal, such as chromium, and the optical density of a corresponding fused disc using this modified dye is shown as curve D in FIG. 2.

Example 3

A toner was prepared using the epoxy resin used in Example 1 and a nigrosine dye (Oil Black BY, Orient Kagaku Co.) only.

This toner, which did not contain carbon, but only the nigrosine dye, exhibited a deep tone and the optical density was as shown by curve E in FIG. 2.

Binder Resin of Toner

Example 4

A toner was prepared with the mixture of 90% by weight of an epoxy resin $E_p$ 1004, 5% by weight of Long Flow Carbon and 5% by weight of a nigrosine dye (Oil Black BY). The preparation procedure was as follows. The binder, carbon and dye were introduced in a kneader, mixed therein at 100° C., for an hour, and cooled naturally for 12 hours. The obtained mass was crushed sequentially by a jaw crusher, a centrifugal mill and a jet pulverizer and the resulting particles were separated 5–25 μm as toner with a blowing classifier.

Bare plate-like iron beads of 100–200 mesh were used as the carrier, which was not coated with a resin.

Printing experiments were then carried out with the condition described in Table 1.

TABLE 1

| Printing Condition | |
|---|---|
| Ratio of surface of carrier to total projection area of toner | ca. 1:1 |
| Development | Magnetic brush process |
| Developing speed | 38 cm/sec. |
| Photoreceptor | ZnO masterpaper |
| Temperature | 23~25° C. |
| Humidity | 35~74% R.H. |
| Fusation | Heating Oven |
| Evaluation | Optical density of fused image |
| Optical densitometer | PD-7R Konishiroku Photo Industry Co., Ltd. |

Figure 3:
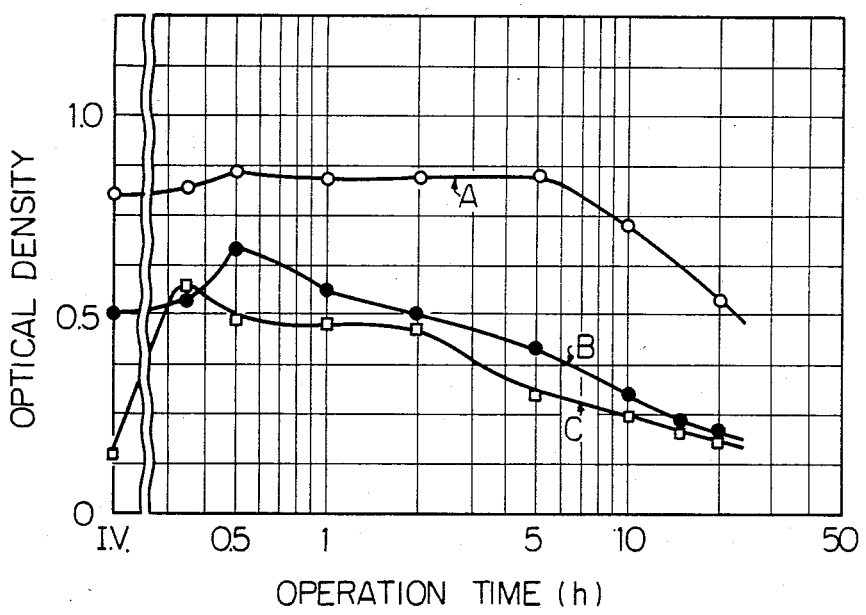
FIG. 3 shows the optical density of a fused image as a function of operating time.

The optical density evaluated at regular time intervals was as shown by curve A in FIG. 3.

Example 5

Three types of toner were prepared in a manner similar to that of the toner of Example 4, except that 5–20% by weight of a higher molecular weight epoxy resin, based on the weight of the resin, such as $E_p$ 1007 (M.W. 1700, epoxy equivalent 1750–2100) or $E_p$ 1009 (M.W. 3750, epoxy equivalent 2400–3000) was added to $E_p$ 1004 (M.W. 1400, epoxy equivalent 900–1000). Thus, the fusing of the toner was successfully improved.

Example 6 (Comparatives)

Two types of toner were prepared in a manner similar to the toner of Example 4, except that the binder was replaced by (B) a styrene based resin (Piccolastic D 100, Pennsylvania Industrial Chemicals Co.) or (C) a styrene/butadiene copolymer resin (2007 J, Nihon Zeon Co.), containing 85% by weight of styrene in polymerized form, based on the weight of the toner.

The results of printing experiments were as shown by curves B and C in FIG. 3. These toners formed toner filming on the surface of the carrier and on the photoreceptor sheet, and, in addition, exhibited a lower optical density than curve (A) of Example 4.

Example 7

0–50% by weight of a styrene/alkylmetacrylate copolymer resin (Hymer SBM-600, Sanyo Kagaku Co., M.W. 60,000) was added to the epoxy resin, based on the weight of the binder resin. The resolution was improved to 10 lines/mm from 9 lines/mm obtained using only an epoxy resin. When the content of this copolymer resin exceeded 50% by weight, the toner exhibited an unfavorable adhesion to the photoconductive sheet ($PVC_z$-TNF-Polyester Binder).

Charge Controlling Agent of Toner

Polyolefin polyamine was added as a charge controlling agent to the toner materials used in the preceeding experiments, so as to improve the triboelectric charging between the toner and the carrier during agitation. Polyolefin polyamine, expressed by the formula:

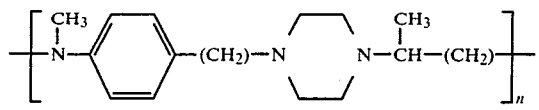

having a molecular weight of 1,000–100,000, was used.

In the following printing experiments, generally, the toner had the composition described in Table 2.

TABLE 2

| Composition of Toner | | |
|---|---|---|
| Binder resin | Epoxy resin (softening point 70° C., melting point 80° C.) | 87 wt % |
| Carbon | Long Flow Carbon | 5 wt % |
| Dye | Nigrosine based dye | 5 wt % |
| Charge controlling agent | Polyolefin polyamine | 3 wt % |

Flash-Fusible Toner

Example 8

A mixture of 92% by weight of an epoxy resin (Epychlon 4050, Dainihon Ink Co., epoxy equivalent 900–1,000, melting point 96°–104° C.), 5% by weight of carbon (Black Pearls L, Cabot Corp., having an average size of 24 μm, and nigrometer index 83), 2% by weight of a nigrosine dye (Nigrosine Black EX, Orient Kagaku Co.) and 1% by weight of di-(polyhydroxy ethoxy ethyl)octadecyl amine was kneaded at 100° C., crushed with a jet pulverizer and separated with a blowing classifier, so as to obtain toner particles. A xenon flash lamp (Ushio Denki Co.) was mounted in a laser printer with a printing speed of 16 cm/min. Fusing was carried out at 300 J/pulse. During fusing, the fusing station of this printer was evacuated at a rate of 1 l/min. Organic vapours in the exhausted air were trapped by a molecular sieve, analysed with a gas chromato-spectrometer provided with an ion multiplier.

Example 9 (Comparative)

A mixture of 46% by weight of an epoxy resin (Epychlon 4050, Dainihon Ink Co.), 46% by weight of styrene/butyl acrylate copolymer resin (Hymer, Sanyo Kasei Kogyo Co., M.W. 60,000, softening point 140° C.), 2% by weight of carbon (Black Pearls L) and 6% by weight of Nigrosine Black EX (Orient Kagaku Co.) was used to prepare toner particles in the same manner as described in Example 8. The toner particles were fused and analyzed in the same manner as in Example 8. The obtained printed matter exhibited an unfavorable odor.

Coating Resin of Carrier

Example 10

A styrene/butadine copolymer was used as a coating resin of the carrier beads, because this copolymer resin can be easily coated on the surface of iron beads. A layer of resin of this copolymer was found to be not easily peeled off from the surface of the iron beads.

The test was carried out as follows. A toner resin was fused on the coating resin which had been coated on an iron plate. The layer of toner resin was peeled off from the coating resin, and the area of the peeled off toner resin in the interface between the toner and the coating resins was measured and expressed in percent. The higher the butadiene content of the coating styrene/-butadiene copolymer became, the more the peeling-off ratio, namely, the non-adherence, was improved. However, the solubility of the copolymer in chloroform decreased as shown in Table 3, and as a result coating became more difficult.

TABLE 3

| | Butadine Content of Coating Resin | | | | |
|---|---|---|---|---|---|
| | coated resin | | | | bare iron |
| Butadiene content (wt %) | 0 | 1 | 7.5 | 20 | — |
| Ratio of peeling off (%) | 60 | 70 | 92 | — | O |
| Solubility in chloroform | O | O | O | X | — |

(note: O . . . good, X . . . fair)

Coated Carrier

Example 11

A non adhering styrene/butadiene copolymer of a butadiene content of 7.5% was used for the preparation of a coated carrier. Spherical iron beads (Air Atomised Spherical Powder ST-200, Kanto Denka Co.) were used as the carrier core. 150 g of the resin was introduced into 3 kg of chloroform in a 20 l exhaustible tank. After the resin was completely dissolved, 15 kg of iron beads of 50–200 μm were poured into the tank. As the tank was rotated between 1 and 2 r.p.m, the content was uniformly mixed, and the evaporating vapor was exhausted during rotation. When the solvent had almost completely evaporated, the coated carrier beads were removed to a stainless steel tank and dried at 110° C., for one hour, and heated at 200° C. for one hour during mixing, so as to cure the coating resin.

The obtained coated carrier was mixed with toner particles having the composition described in Table 2, and subjected to the printing test, the conditions of which are described in Table 1, above. The printing performance was found to be stable.

Further, when thin plate-like iron flakes (EFV 100/200, Nihon Teppun Co.), thick iron flakes (DSP-128B, Dowa Iron Powder Co. Ltd.) or glass beads were used as core particles, the results obtained were similar to the case of spherical iron beads.

Example 12

As the butadiene content in styrene/butadiene copolymer was increased, the solubility was lowered as shown in Table 3. Cyclized cis-1,4-polybutadiene (CBR-L, Japan Synthetic Co., Ltd.), which exhibited good solubility, was mixed with styrene/butadiene copolymer, containing 7.5% by weight of butadiene in polymerized form. 35 g of 1,2-polybutadiene, 100 g of cyclized cis-1,4-polybutadiene and 15 g of styrene/-butadiene copolymer, containing 7.5% of butadiene in polymerized form, were dissolved in 3 kg of trichloroethylene. 15 kg of fine spherical shots of blueish oxidized iron, having a size of 100–240 μm, were added to the resulting solution and mixed therewith.

The solvent in the solution was evaporated by the rotary drying method described in Example 11. As a result, the iron beads were coated to a thickness of about 1 μm. Then, the coated beads were heated at 180° C., for two hours, so as to cure the coating resin.

The obtained coated carrier beads were mixed with the toner having the composition described in Table 2. A printing test was carried out under the conditions described in Table 1, above. The developer material was put in a magnetic brush development apparatus. Test patterns were developed and transferred onto plain paper, and fused thereon by heating. The optical density of the printed images was determined. The optical density exhibited more than 1.5, even when printing was continued for over 400 hours.

Figure 4:
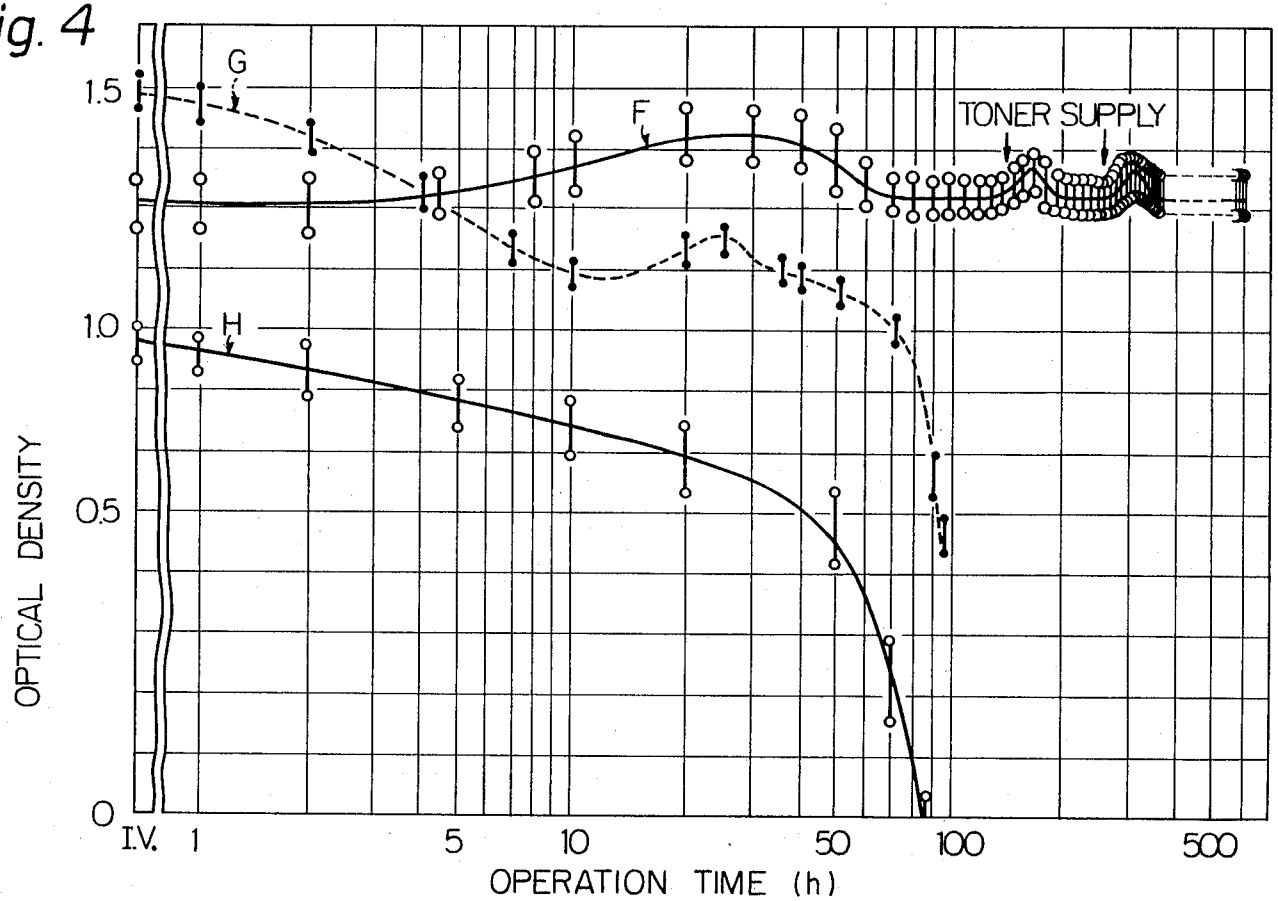
FIG. 4 shows the optical density of an image as a function of operating time.

The optical density of the images using this developer material is shown as curve F in FIG. 4.

Example 13 (Comparative)

Other developer materials were used in a printing test as comparison. The operational conditions were the same as in Example 12. Curve H, in FIG. 4, represents the optical density obtained by a prior art toner and a bare carrier of iron beads, and curve G, in FIG. 4, represents that obtained by the toner having the composition described in Table 2, above, and bare carrier of thick iron flakes (DSP-128 B).

Ratio of Total Surface of Carrier to Total Projection area of Toner Particles

Example 14

The mixing ratio of carrier to toner particles was determined as follows. The ratio $1/\eta$ of the total surface area of carrier beads to the total projection area of toner particles was determined from the distribution of size of toner particles and carrier beads. The triboelectric charge density $\sigma$ on the surface of the toner was determined. The relationship between $\eta$ and $1/\sigma$ was plotted. The toner had the composition described in Table 2, above, and the carrier beads were coated with a styrene/butadiene copolymer having 7.5% by weight of butadiene in polymerized form, based on the weight of the copolymer resin. The size distribution of the toner was 4–30 μm and that of the carrier 160–680 μm.

Figure 5:
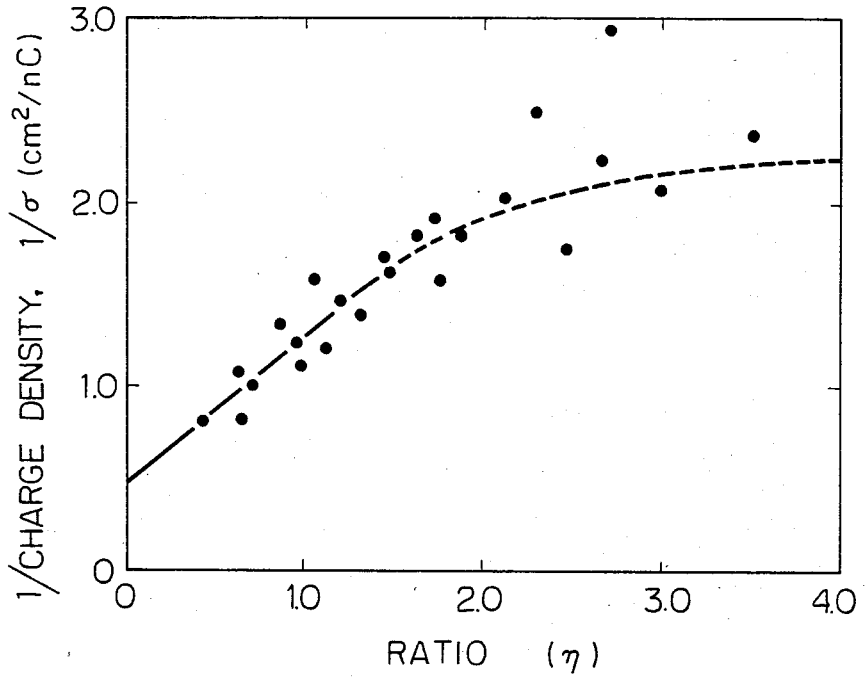
FIG. 5 shows the reciprocal charge density as a function of the ratio of the total surface area of the carrier to the total projection area of the toner particles.

As shown in FIG. 5, when $\eta$ is less than 0.5, the development current could not be detected, and when $\eta$ is more than 2, the toner in the developer material was not stably charged, because the toner particles were so densely adhered on the carrier that they were apt to be thrown off from the carrier. Therefore, the ratio $\eta$ is, according to the present invention, in the range of from 0.5 to 2.0 and is, preferably, in the range of from 0.6 to 1.2.

What we claim is:

1. A developer material for electrostatic images comprising a mixture of a coated carrier and toner particles, wherein:

(1) said carrier comprises iron core beads coated with a coating resin comprising at least one butadiene homopolymer of a molecular weight of from 10,000 to 100,000, each said homopolymer being 1,2-polybutadiene or cyclized cis-1,4-polybutadiene, or a mixture of at least one of said homopolymers and a styrene/butadiene copolymer of a molecular weight of from 10,000 to 100,000, said mixture containing an effective amount of at least 7.5% by weight, based on the weight of said mixture, of butadiene in polymerized form; and (2) said toner comprises, based on the weight of said toner:

(A) from 85 to 95% by weight of a binder resin comprising, based on the weight of said binder resin, at least 50% by weight of an epoxy resin of a molecular weight of from 900 to 8,000 and an epoxy equivalent in the range from 450 to 5,500, and an effective amount up to 50% by weight of a styrene/alkyl methacrylate copolymer, the alkyl group of said copolymer having from 1 to 4 carbon atoms, of a molecular weight of from 10,000 to 100,000;

(B) a colorant comprising, based on the weight of said toner, an effective amount up to 10% by weight of fine carbon and from about 0.5 to 8% by weight of a nigrosine dye, and (C) an effective amount up to 8% by weight of a charge controlling agent, based on the weight of said toner, comprising a quaternary ammonium alkyl sulfonate, this alkyl group having from 4 to 20 carbon atoms, di-(polyhydroxy ethoxy ethyl-)octadecyl amine, or a polyamine; and the ratio of the total surface area of said carrier to the total projection area of said toner particles being in the range of from 1:0.5 to 1:2.0.

2. A developer material as claimed in claim 1, wherein said polyamine is a polyolefin polyamine of a molecular weight of from 1,000 to 100,000, expressed by the formula:

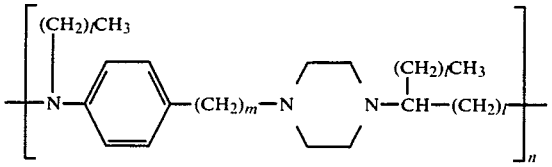

where l=0 or 1 and m=1 or 2.

3. A developer material as claimed in claim 1, wherein said coating resin contains more than 90% by weight of said butadiene in polymerized form, based on the weight of said coating resin.

4. A developer material as claimed in claim 1, wherein said coating resin further comprises an effective amount of less than 10% by weight of a flourine containing polymer, based on the weight of said coating resin.

5. A developer material as claimed in claim 1 or 2, wherein the thickness of the coating is in the range of from 0.3 to 20 um.

6. A developer material as claimed in claim 1 or 2, wherein the thickness of the coating is in the range of from 0.7 to 2.0 um.

7. A developer material as claimed in claim 1, wherein the core beads of said coated carrier are selected from the group consisting of spherical iron shot, thin plate-like iron flakes and thick iron flakes.

8. A developer material as claimed in claim 1, wherein said toner comprises from 3 to 6% by weight of said carbon, based on the weight of said toner.

9. A developer material as claimed in claim 1, wherein said toner comprises from 1 to 3% by weight of said nigrosine dye, based on the weight of said toner.

10. A developer material as claimed in claim 1, 2, 3, 4, 5, 6, 7, 8 or 9 wherein said toner comprises from 2 to 4% by weight of said charge controlling agent, based on the weight of said toner.

11. A developer material as claimed in claim 1 2, 3, 4, 5, 6, 7, 8 or 9, wherein said toner comprises, based on the weight of said toner:

(A) said binder resin comprising more than 95% by weight, based on said binder resin, of a bis-phenol A/epichlorohydrin type of said epoxy resin having a melting point in the range from 60° to 160° C.; and (B) said colorant comprising, based on the weight of said toner, from 0.6 to 8% by weight of said carbon and up to 5% by weight of said nigrosine dye.

12. A developer material as claimed in claim 1, 2, 3, 4, 5, 6, 7, 8 or 9, wherein said ratio of the total surface area of said carrier to the total projection area of said toner particles is in the range of from 1:0.6 to 1:1.2.

13. The developer material of claim 11, wherein said ratio of the total surface area of said carrier to the total projection area of said toner particles is in the range of from 1:0.6 to 1:1.2.

14. The developer material of claim 11, wherein said toner comprises from 2 to 4% by weight of the charge controlling agent, based on the weight of said toner.

* * * * *

UNITED STATES PATENT AND TRADEMARK OFFICE

CERTIFICATE OF CORRECTION

PATENT NO. : 4,513,075

DATED : Apr. 23, 1985

INVENTOR(S) : Toshiaki Narusawa et al

It is certified that error appears in the above-identified patent and that said Letters Patent is hereby corrected as shown below:

Column 1, line 44, "charger" should be --charged--;
line 63, "corotron" should be --coronatron--.

Column 4, line 51, "metacrylate" should be --methacrylate--;
line 66, "(p-hydroxy" should be --(polyhydroxy--.

Column 5, line 12, "l" (first occurrence) should be a script --ℓ-- as in the formula;
line 24, after "from" insert --about--;
line 51, after "from" insert --about--;
line 57, "tadeyl" should be --tadecyl--.

Column 6, line 27, after "resin" insert --of--;
line 45, "migrometer" should be --nigrometer--;
line 46, delete "a".

Column 7, line 62, "styrene/alkylmetacrylate" should be --styrene/alkyl methacrylate--.

Column 9, line 56, after "Synthetic" insert --Rubber--.

Column 10, line 19, delete "as";

UNITED STATES PATENT AND TRADEMARK OFFICE

CERTIFICATE OF CORRECTION

PATENT NO. : 4,513,075

DATED : Apr. 23, 1985

INVENTOR(S) : Toshiaki Narusawa et al

It is certified that error appears in the above-identified patent and that said Letters Patent is hereby corrected as shown below:

Column 11, line 21, "-" should be --)--;
line 22, ")octadecyl" should be --octadecyl--;
line 39, "l" should be --ℓ--; "m" should be a script --𝓂--.

Signed and Sealed this

*Fifteenth* Day of *October 1985*

[SEAL]

*Attest:*

*Attesting Officer*

DONALD J. QUIGG

*Commissioner of Patents and Trademarks—Designate*